US010352270B2

(12) United States Patent
Weinenger et al.

(10) Patent No.: US 10,352,270 B2
(45) **Date of Patent: *Jul. 16, 2019**

(54) GALLERYLESS PISTON WITH CONNECTION TO POCKETS

(71) Applicant: TENNECO INC., Lake Forest, IL (US)

(72) Inventors: Michael Weinenger, Southfield, MI (US); Jeffrey L. Riffe, Troy, MI (US)

(73) Assignee: Tenneco Inc., Lake Forest, IL (US)

( * ) Notice: Subject to any disclaimer, the term of this patent is extended or adjusted under 35 U.S.C. 154(b) by 67 days.

This patent is subject to a terminal disclaimer.

(21) Appl. No.: 15/441,659

(22) Filed: Feb. 24, 2017

(65) Prior Publication Data

US 2017/0254290 A1 Sep. 7, 2017

Related U.S. Application Data

(60) Provisional application No. 62/302,040, filed on Mar. 1, 2016.

(51) Int. Cl.

| | |
|---|---|
| ***F02F 3/22*** | (2006.01) |
| ***F02F 3/26*** | (2006.01) |
| ***F02F 3/20*** | (2006.01) |

(52) U.S. Cl.

CPC ..... *F02F 3/22* (2013.01); *F02F 3/20* (2013.01); *F02F 3/26* (2013.01); *F02F 2200/04* (2013.01); *F02F 2200/06* (2013.01)

(58) Field of Classification Search

CPC ..... F02F 3/22; F02F 3/20; F02F 3/26; F02F 2200/04; F02F 2200/06

(Continued)

(56) References Cited

U.S. PATENT DOCUMENTS

| | | | |
|---|---|---|---|
| 1,327,147 | A | 1/1920 | Church |
| 1,526,491 | A | 2/1925 | Cox |

(Continued)

FOREIGN PATENT DOCUMENTS

| | | | |
|---|---|---|---|
| DE | 3826746 | A1 | 3/1989 |
| DE | 102014210876 | A1 | 12/2015 |

(Continued)

OTHER PUBLICATIONS

International Search Report, dated May 15, 2017 (PCT/US2017/019610).

*Primary Examiner* — Marguerite J McMahon
(74) *Attorney, Agent, or Firm* — Robert L. Stearns; Dickinson Wright, PLC

(57) ABSTRACT

A piston galleryless piston capable achieving improved thermal efficiency, fuel consumption, and engine performance is provided. The piston includes an undercrown surface exposed from an underside of the piston, a ring belt, pin bosses, and a pair of skirt panels coupled to the pin bosses by struts. The piston includes an inner undercrown region extending along the undercrown surface and surrounded by the skirt panels, struts, and pin bosses. The piston also includes a pair of outer pockets extending along the undercrown surface and each being surrounded by a portion of the ring belt, one of the pin bosses, and the struts coupling the one pin boss to the skirt panels. Each pin boss includes an opening extending from the inner undercrown region to one of the outer pockets for conveying cooling oil. The opening is located between a pin bore of the associated pin boss and the undercrown surface.

19 Claims, 6 Drawing Sheets

(58) Field of Classification Search
USPC ..... 123/193.6
See application file for complete search history.

(56) References Cited

U.S. PATENT DOCUMENTS

| | | | |
|---|---|---|---|
| 2,860,934 | A | 11/1958 | Trevarthen |
| 2,991,769 | A | 7/1961 | Chapin |
| 3,992,980 | A | 11/1976 | Ryan et al. |
| 4,068,563 | A | 1/1978 | Ryan et al. |
| 4,350,083 | A | 9/1982 | Gannaway |
| 4,674,399 | A | 6/1987 | Bruni |
| 4,909,132 | A | 3/1990 | Kling et al. |
| 4,969,433 | A | 11/1990 | Sougawa |
| 5,063,893 | A | 11/1991 | Iwaya |
| 6,668,703 | B2 | 12/2003 | Gamble |
| 7,066,132 | B1 | 6/2006 | Verbrugge et al. |
| 8,453,559 | B2 | 6/2013 | Ohmori et al. |
| 8,601,994 | B2 | 12/2013 | Mukouhara et al. |
| 8,662,049 | B2 | 3/2014 | Nodl |
| 8,910,609 | B2 | 12/2014 | Rothkegel |
| 9,004,037 | B2 | 4/2015 | Muscas |
| 2003/0051694 | A1* | 3/2003 | Gaiser ..... F02F 3/003 123/193.6 |
| 2005/0092279 | A1* | 5/2005 | Parker ..... F02B 23/0672 123/193.6 |
| 2007/0235003 | A1* | 10/2007 | Cagney ..... B22F 5/008 123/279 |
| 2010/0229820 | A1* | 9/2010 | Iwata ..... F02F 3/00 123/193.6 |
| 2013/0233270 | A1 | 9/2013 | Brandt et al. |
| 2015/0122212 | A1 | 5/2015 | Riffe et al. |
| 2016/0090939 | A1* | 3/2016 | Riffe ..... F02F 3/00 123/193.6 |
| 2017/0241374 | A1* | 8/2017 | Scherbaum ..... F02F 3/0076 |
| 2017/0260927 | A1* | 9/2017 | Weinenger ..... F02F 3/22 |

FOREIGN PATENT DOCUMENTS

| | | | |
|---|---|---|---|
| FR | 37786 | E | 1/1931 |
| JP | H02078753 | | 3/1990 |
| JP | H02091452 | | 3/1990 |
| JP | H02091453 | | 3/1990 |
| JP | 2007107503 | A | 4/2007 |
| WO | 2016070031 | A1 | 5/2016 |

* cited by examiner

GALLERYLESS PISTON WITH CONNECTION TO POCKETS

CROSS-REFERENCE TO RELATED APPLICATION

This U.S. utility patent application claims priority to U.S. provisional patent application No. 62/302,040, filed Mar. 1, 2016, the contents of which is incorporated herein by reference in its entirety.

BACKGROUND OF THE INVENTION

1. Technical Field

This invention relates generally to pistons for internal combustion engines, and methods of manufacturing the pistons.

2. Related Art

Engine manufacturers are encountering increasing demands to improve engine efficiencies and performance, including, but not limited to, improving fuel economy, reducing oil consumption, improving fuel systems, increasing compression loads and operating temperatures within the cylinder bores, reducing heat loss through the piston, improving lubrication of component parts, decreasing engine weight and making engines more compact, while at the same time decreasing the costs associated with manufacture.

While desirable to increase the compression load and operation temperature within the combustion chamber, it remains necessary to maintain the temperature of the piston within workable limits. Also, achieving an increase in the compression load and operation temperature comes with a tradeoff in that these desirable "increases" limit the degree to which the piston compression height, and thus, overall piston size and mass can be decreased. This is particularly troublesome with typical piston constructions having a closed or partially closed cooling gallery to reduce the operating temperature of the piston. The cost to manufacture pistons having upper and lower parts joined together along a bond joint to form the closed or partially closed cooling gallery is generally increased due to the joining process used to bond the upper and lower parts together. Further, the degree to which the engine weight can be reduced is impacted by the need to make the aforementioned "cooling gallery-containing" pistons from steel so they can withstand the increase in mechanical and thermal loads imposed on the piston.

Recently, single piece steel pistons without a cooling gallery have been developed and can be referred to as "galleryless" pistons. Such pistons provide for reduced weight, reduced manufacturing costs, and reduced compression height. The galleryless pistons are either spray cooled by a cooling oil nozzle, lightly sprayed for lubrication only, or are not sprayed with any oil. Due to the absence of the cooling gallery, such pistons typically experience higher temperatures than pistons with a conventional cooling gallery. High temperatures can cause oxidation or overheating of an upper combustion surface of the steel piston, which can then cause successive piston cracking and possible engine failures. High temperatures can also cause oil degradation along an undercrown area of the piston, for example underneath a combustion bowl where the cooling or lubrication oil is sprayed. Another potential problem arising due to high temperatures is that the cooling oil can create a thick layer of carbon in the area where the cooling or lubrication oil is in contact with the piston undercrown. This carbon layer can cause overheating of the piston with potential cracking and engine failure.

SUMMARY

One aspect of the invention provides a piston for an internal combustion engine capable of providing improved thermal efficiency, fuel consumption, and engine performance. The piston includes an upper wall including an undercrown surface which is exposed from an underside of the piston. The piston also includes a ring belt depending from the upper wall and extending circumferentially around a center axis of the piston. A pair of pin bosses depends from the upper wall, and a pair of skirt panels depends from the ring belt and are coupled to the pin bosses by struts. An inner undercrown region extends along the undercrown surface and is surrounded by the skirt panels, the struts, and the pin bosses. A pair of outer pockets extends along the undercrown surface, and each outer pocket is surrounded by one of the pin bosses, a portion of the ring belt, and the struts coupling the one pin boss to the adjacent skirt panels. The piston further includes an opening extending through one of the pin bosses from the inner undercrown region to one of the outer pockets.

Another aspect of the invention provides a method of manufacturing a piston. The method includes providing a body including an upper wall, the upper wall including an undercrown surface exposed from an underside of the piston, a ring belt depending from the upper wall and extending circumferentially around a center axis of the piston, a pair of pin bosses depending from the upper wall, a pair of skirt panels depending from the ring belt and coupled to the pin bosses by struts, an inner undercrown region extending along the undercrown surface and surrounded by the skirt panels and the struts and the pin bosses, a pair of outer pockets extending along the undercrown surface, each outer pocket being surrounded by one of the pin bosses a portion of the ring belt and the struts coupling the one pin boss to the adjacent skirt panels. The method further includes forming an opening extending through one of the pin bosses from the inner undercrown region to one of the outer pockets.

BRIEF DESCRIPTION OF THE DRAWINGS

These and other aspects, features and advantages of the invention will become more readily appreciated when considered in connection with the following detailed description and accompanying drawings, in which.

DETAILED DESCRIPTION OF EXEMPLARY EMBODIMENTS

FIGS. 1-6 illustrate views of a piston 10 constructed in accordance with example embodiments of the invention for reciprocating movement in a cylinder bore or chamber (not shown) of an internal combustion engine, such as a modern, compact, high performance vehicle engine, for example. The piston 10 is galleryless and thus has a reduced weight or mass compared to pistons with cooling galleries. The piston 10 can also operate at a reduced temperature during operation in an internal combustion engine compared to other galleryless pistons. The piston 10 also contributes to improved thermal efficiency, fuel consumption, and performance of the engine.

Figure 1:
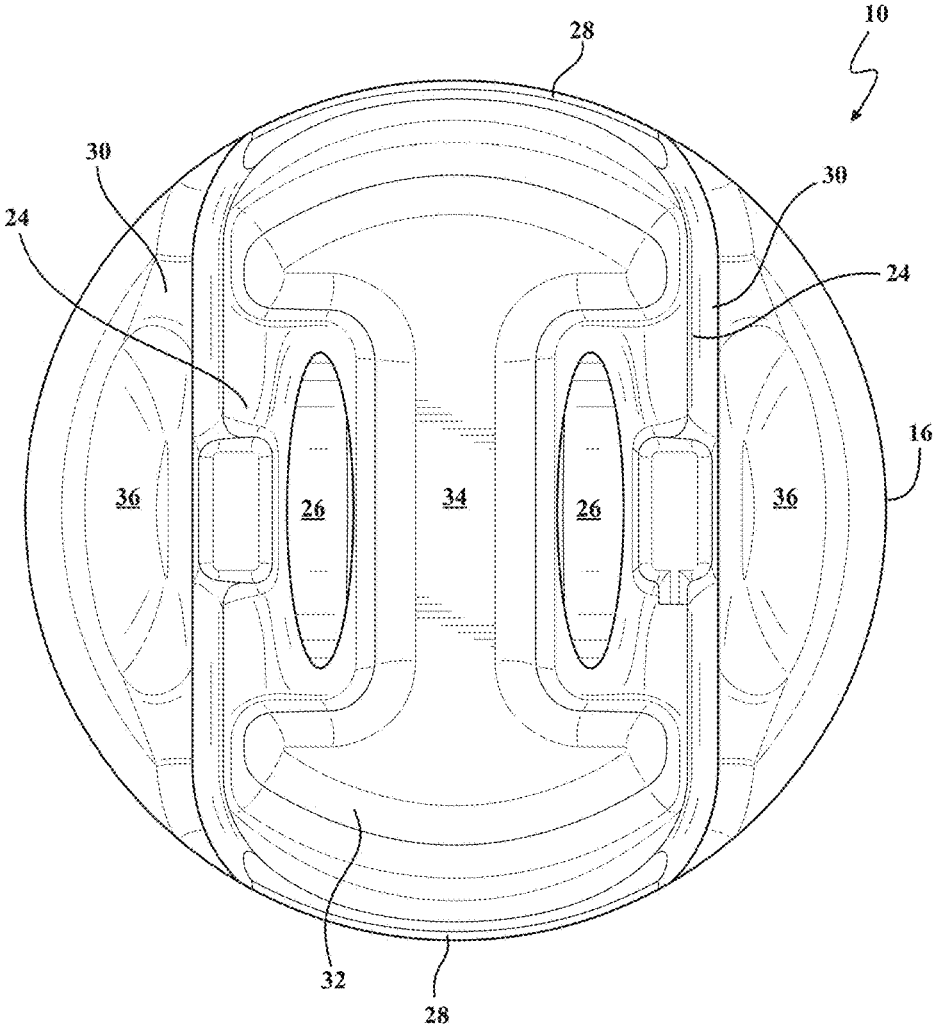
FIG. 1 is a bottom view of a galleryless piston which can include an opening in a pin boss according to an example embodiment of the invention.

As shown in the Figures, the piston 10 has a monolithic body formed from a single piece of metal material, such as steel. The monolithic body can be formed by machining, forging or casting, with possible finish machining performed thereafter, if desired, to complete construction. Accordingly, the piston 10 does not have a plurality of parts joined together, such as upper and lower parts joined to one another, which is commonplace with pistons having enclosed or partially enclosed cooling galleries bounded or partially bounded by a cooling gallery floor. To the contrary, the piston 10 is "galleryless" in that it does not have a cooling gallery floor or other features bounding or partially bounding a cooling gallery. A bottom view of the galleryless piston 10 is shown in FIG. 1, and cross-sectional view of the galleryless piston are shown in FIGS. 2-6.

The body portion, being made of steel or another metal, is strong and durable to meet the high performance demands, i.e. increased temperature and compression loads, of modern day high performance internal combustion engines. The steel material used to construct the body can be an alloy such as the SAE 4140 grade or different, depending on the requirements of the piston 10 in the particular engine application. Due to the piston 10 being galleryless, the weight and compression height of the piston 10 is minimized, thereby allowing an engine in which the piston 10 is deployed to achieve a reduced weight and to be made more compact, relative to pistons including a cooling gallery. Further yet, even though the piston 10 is galleryless, the piston 10 can be sufficiently cooled during use to withstand the most severe operating temperatures.

The body portion of the piston 10 has an upper head or top section providing an upper wall 12. The upper wall 12 includes an upper combustion surface 14 that is directly exposed to combustion gasses within the cylinder bore of the internal combustion engine. In the example embodiment, the upper combustion surface 14 forms a combustion bowl, or a non-planar, concave, or undulating surface around a center axis A. A ring belt 16 providing a top land 18 followed by a plurality of ring grooves 20 depends from the upper wall 12 and extends circumferentially along an outer diameter of the piston 10.

The piston 10 further includes a pair of pin bosses 24 depending generally from the upper wall 12 and an undercrown surface 34, inwardly of the ring belt 16. The pin bosses 24 and providing a pair of laterally spaced pin bores 26 which are vertically spaced from the undercrown surface 32. The piston 10 also includes a pair of skirt panels 28 depending from the ring belt 16 and located diametrically opposite one another. The skirt panels 28 are coupled to the pin bosses 24 by struts 30.

The undercrown surface 32 of the piston 10 is located on an underside of the upper wall 12, directly opposite the upper combustion surface 14 and radially inwardly of the ring belt 16. The undercrown surface 32 is preferably located at a minimum distance from the combustion bowl and is substantially the surface on the direct opposite side from the combustion bowl. The undercrown surface 32 is defined here to be the surface that is visible, excluding any pin bores 26, when observing the piston 10 straight on from the bottom. The undercrown surface 32 is generally form fitting to the combustion bowl of the upper combustion surface 14. The undercrown surface 32 is also openly exposed, as viewed from an underside of the piston 10, and it is not bounded by an enclosed or partially enclosed cooling gallery.

The undercrown surface 32 of the piston 10 has greater a total surface area (3-dimensional area following the contour of the surface) and a greater projected surface area (2-dimensional area, planar, as seen in plan view) than comparative pistons having a closed or partially closed cooling gallery. This open region along the underside of the piston 10 provides direct access to oil splashing or being sprayed from within the crankcase directly onto the undercrown surface 32, thereby allowing the entire undercrown surface 32 to be splashed directly by oil from within the crankcase, while also allowing the oil to freely splash about the wrist pin (not shown), and further, significantly reduce the weight of the piston 10. Accordingly, although not having a typical closed or partially closed cooling gallery, the generally open configuration of the galleryless piston 10 allows optimal cooling of the undercrown surface 32 and lubrication to the wrist pin joint within the pin bores 26, while at the same time reducing oil residence time on the surfaces near the combustion bowl, which is the time in which a volume of oil remains on the surface. The reduced residence time can reduce unwanted build-up of coked oil, such as can occur in pistons having a closed or substantially closed cooling gallery. As such, the piston 10 can remain "clean" over extended use, thereby allowing it to remain substantially free of build-up.

The undercrown surface 32 of the piston 10 of the example embodiment is provided by several regions of the piston 10, including an inner undercrown region 34 and outer pockets 36, which are best shown in FIGS. 1 and 4-6. A first portion of the undercrown surface 32 located at the center axis A is provided by the inner undercrown region 34. The inner undercrown region 34 is surrounded by the pin bosses 24, skirt panels 28, and struts 30. The 2-dimensional and 3-dimensional surface area of the undercrown surface 32 provided by the inner undercrown region 34 is typically maximized so that cooling caused by oil splashing or being sprayed upwardly from the crankcase against the exposed surface can be enhanced, thereby lending to exceptional cooling of the piston 10. In the example embodiments of FIGS. 2-4, the undercrown surface 32 of the inner undercrown 34 region is concave, when viewed from the bottom, such that oil can be channeled during reciprocation of the piston 10 from one side of the piston 10 to the opposite side of the piston 10, thereby acting to further enhance cooling of the piston 10.

A second region of the undercrown surface 32 is provided by the outer pockets 36 which are located outwardly of the pin bosses 24. Each outer pocket 36 is surrounded by one of the pin bosses 24, portions of the struts 30 connecting the one pin boss 24 to the adjacent skirt panel 28, and a portion of the ring belt 16.

To reduce the weight and temperature of the piston 10 during operation, at least one of the pin bosses 24, and preferably both pin bosses 24, includes an opening 38 to connect the inner undercrown region 34 to the adjacent outer pockets 36. The opening 38 or pair of openings 38 is preferably disposed along the undercrown surface 32 to increase the surface area of the undercrown surface 32 which can be splashed with cooling oil. The openings 38 can also allow cooling oil to pass from the inner undercrown region 34 to the outer pockets 36, thus improving the cooling of the outer pockets 36 and reducing the temperature of the piston 10 during operation. The openings 38 also reduce the mass of the piston 10, and increase the surface area of the undercrown surface 32 such that the cooling oil can remove more heat and thus reduce the temperature of the piston 10.

Figure 2:
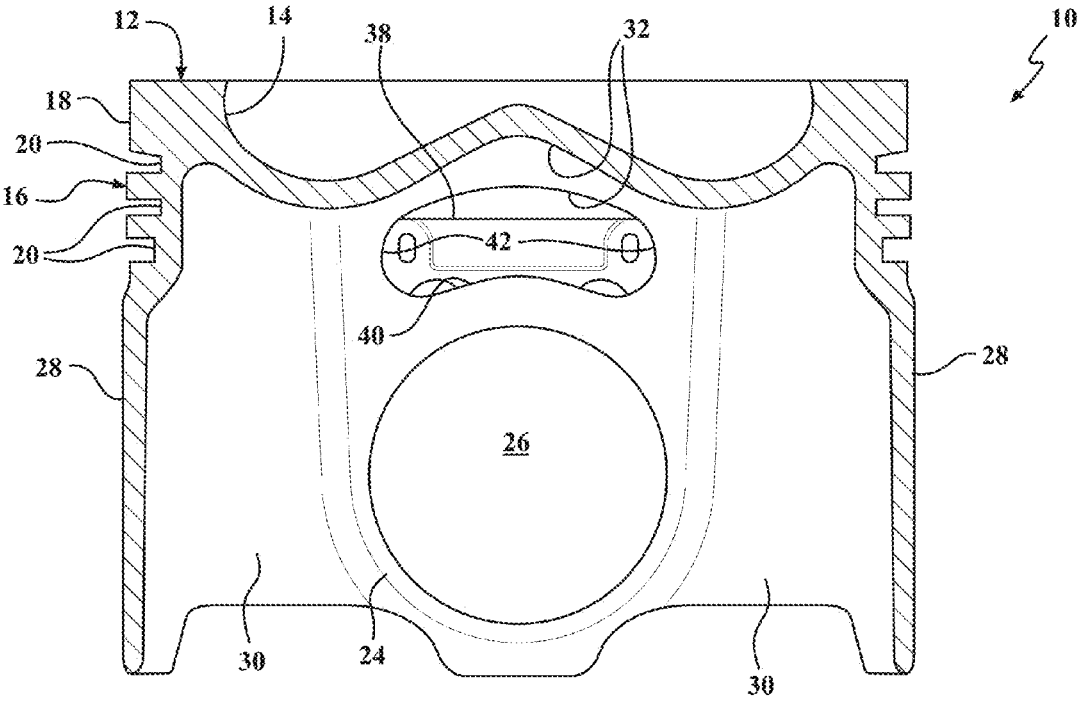
FIG. 2 is a side cross-sectional view of a galleryless piston including an opening in a pin boss according to an example embodiment of the invention.
Figure 3:
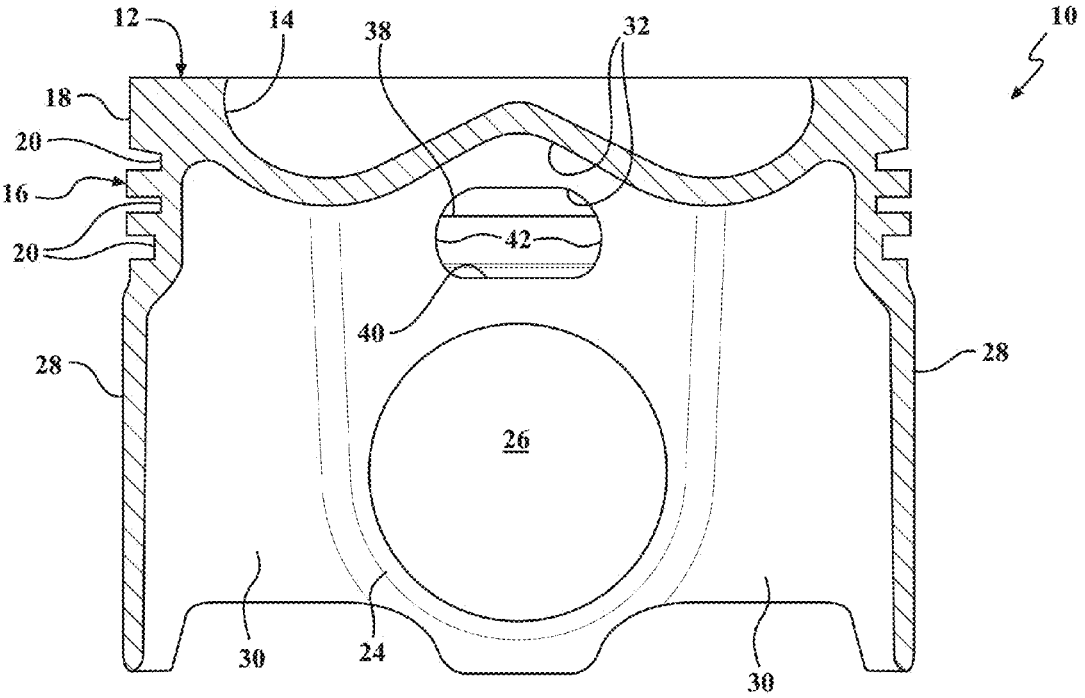
FIG. 3 is a side cross-sectional view of a galleryless piston including an opening in a pin boss according to another example embodiment.

In the example embodiment, there is one opening 38 above each pin bore 26, and each opening 38 is located directly above the associated pin bore 26, between the undercrown surface 32 and the associated pin bore 26. Thus, the openings 38 are longitudinally aligned with the pin bores 26, when viewed from a side of the piston 10 in cross-section. Preferably, the center of the opening 38 is longitudinally aligned with the center of the pin bore 26. The opening 38 is also spaced from the pin bore 26 by a portion of the pin boss 24. For both openings 38, the cross-sectional area of the opening 38 is less than the cross-sectional area of the adjacent pin bore 26 when the piston 10 is viewed in cross-section from the side facing the pin boss 24, as shown in FIGS. 2 and 3. Typically, the cross-sectional area of the opening 38 is 10% to 50% of the cross-sectional area of the pin bore 26. Also, the cross-sectional area of the opening 38 typically varies by not more than 50% between the inner undercrown region 34 and the outer pockets 36. The openings 38 can be cast along with the body portion of the piston 10, or machined in the cast body portion of the piston 10.

The openings 38 can have various different configurations to allow the passage of cooling oil from the inner undercrown region 34 to the outer pockets 36, in various different manners to improve the cooling of the outer pockets 36.

In the example embodiment of FIG. 2, the cross-sectional shape presented by the undercrown surface 32 is upwardly curved or sloped along the opening 38 relative to a center of the opening 38, when viewed from a side of the piston 10 in a direction facing the pin boss 24. The opening 38 is also defined by a lower surface 40 which is upwardly curved or sloped relative to the center of the opening 38, when viewed from a side of the piston 10 in a direction facing the pin boss 24. In other words, the undercrown surface 32 is concave and the lower surface 40 is convex relative to the center of the opening 38. Both the undercrown surface 32 and the lower surface 40 along the opening 38 are curved in the same direction as an uppermost surface of the pin bore 26. The opening 38 is also defined by side surfaces 42 connecting the undercrown surface 32 and the lower surface 40. The side surfaces 42 are curved between the undercrown surface 32 and the lower surface 40. The side surfaces 42 are concave relative to the center of the opening 38 when viewed from a side of the piston 10 in a direction facing the pin boss 24. Also, in the example embodiment of FIG. 2, the openings 38 each have a length extending from the undercrown surface 32 to the lower surface 40, and a width extending between the opposite side surfaces 42 which is greater than the length.

Figure 2A:
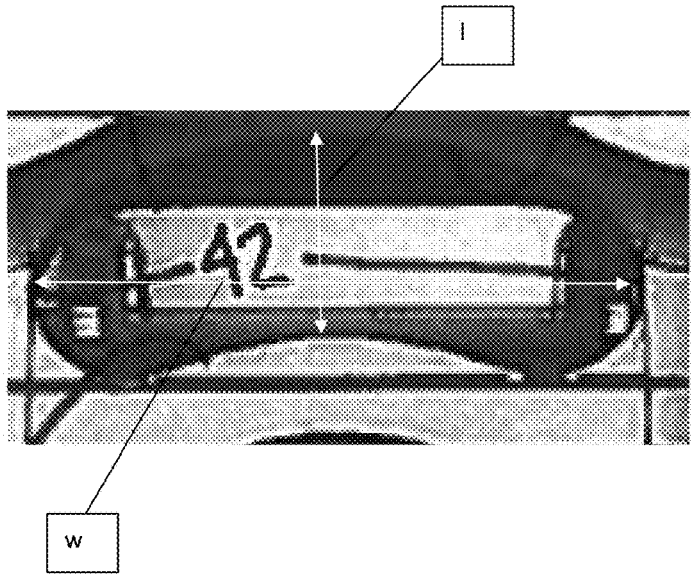
FIG. 2A is an enlarged view of an opening of the piston of FIG. 2 wherein a length and width of the opening are identified.

In the example embodiment of FIG. 2, the cross-sectional shape presented by the undercrown surface 32 is upwardly curved or sloped along the opening 38 relative to a center of the opening 38, when viewed from a side of the piston 10 in a direction facing the pin boss 24. The opening 38 is also defined by a lower surface 40 which is upwardly curved or sloped relative to the center of the opening 38, when viewed from a side of the piston 10 in a direction facing the pin boss 24. In other words, the undercrown surface 32 is concave and the lower surface 40 is convex relative to the center of the opening 38. Both the undercrown surface 32 and the lower surface 40 along the opening 38 are curved in the same direction as an uppermost surface of the pin bore 26. The opening 38 is also defined by side surfaces 42 connecting the undercrown surface 32 and the lower surface 40. The side surfaces 42 are curved between the undercrown surface 32 and the lower surface 40. The side surfaces 42 are concave relative to the center of the opening 38 when viewed from a side of the piston 10 in a direction facing the pin boss 24. Also, in the example embodiment of FIG. 2, the openings 38 each have a length 1 extending from the undercrown surface 32 to the lower surface 40, and a width w extending between the opposite side surfaces 42 which is greater than the length 1. The length 1 and the width w are identified in FIG. 2A.

Figure 4:
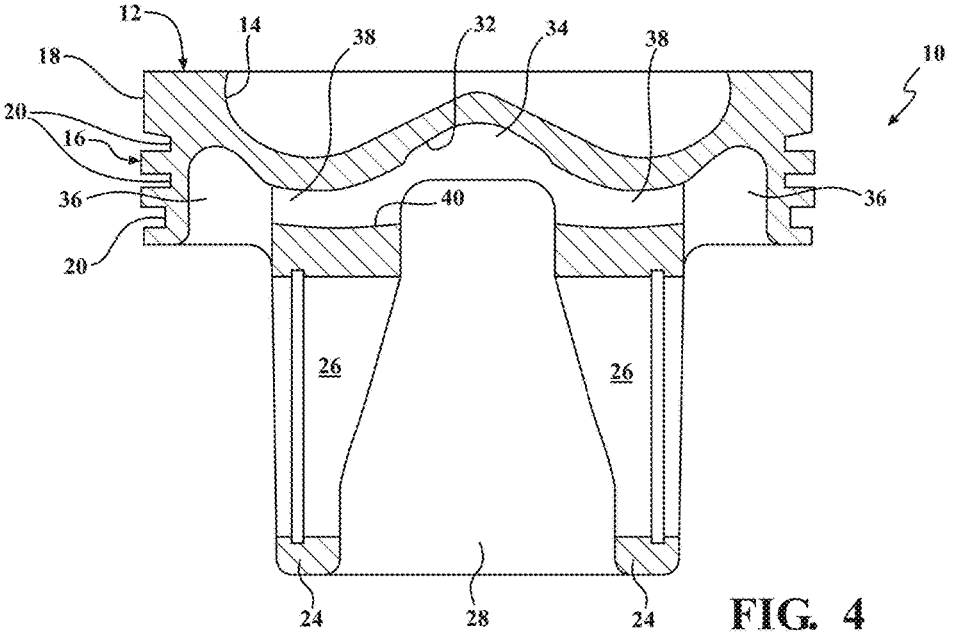
FIG. 4 is a side-cross-sectional view of a galleryless piston including an opening in a pin boss according to yet another example embodiment.

The piston 10 of FIG. 4 is rotated 90 degrees about its center axis A, compared to the pistons 10 of FIGS. 2 and 3. In this case, the piston 10 is viewed in cross-section along the width of the pin bore 26. It is noted that the width of the pin bore 26 extends radially from the inner undercrown region 34 to the outer pocket 36. In this embodiment, the undercrown surface 32 is curved or sloped, such that it is convex relative to the center of the opening 38. The lower surface 40 of the opening 38 is straight, such that it extends perpendicular to the center axis A of the piston 10.

Figure 5:
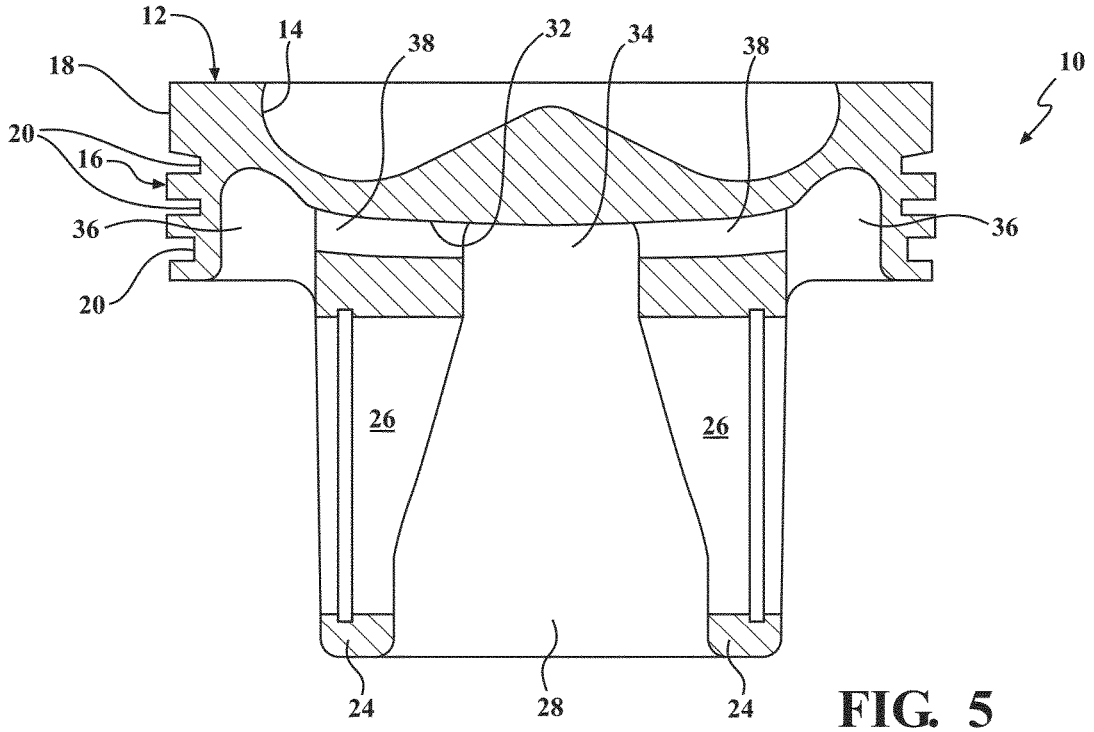
FIG. 5 is a side-cross-sectional view of a galleryless piston including an opening in a pin boss according to another example embodiment.

The piston 10 of FIG. 5 is also rotated 90 degrees about its center axis A, compared to the pistons 10 of FIGS. 2 and 3. In this case, the piston 10 is viewed in cross-section along the width of the pin bore 26. In the embodiment of FIG. 5, the undercrown surface 32 is very slightly curved along the opening 38, and the lower surface 40 of the opening 38 extends straight from the inner undercrown region 34 to the outer pockets 36. In this case, the lower surface 40 extends perpendicular to the center axis A of the piston 10.

Figure 6:
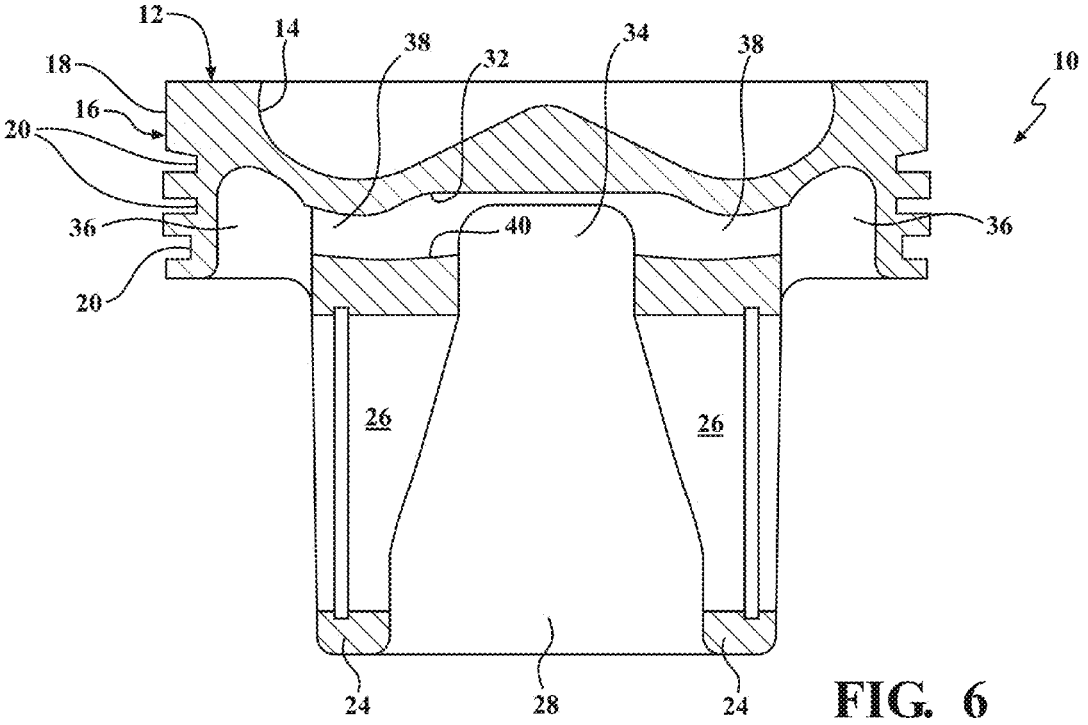
FIG. 6 is a side-cross-sectional view of a galleryless piston including an opening in a pin boss according to yet another example embodiment.

The piston 10 of FIG. 6 is also rotated 90 degrees about its center axis A, compared to the pistons 10 of FIGS. 2 and 3. In this case, the piston 10 is viewed in cross-section along the width of the pin bore 26. In the embodiment of FIG. 6, the undercrown surface 32 extends straight from the inner undercrown region 34 along a first portion of the opening 38, and then curves inwardly to present a convex shape, relative to the center of the opening 38 along a second portion of the opening 38. The second portion having the convex shape extends from the straight first portion to the outer pocket 36. The lower surface 40 of the opening 38 is slightly curved from the inner undercrown region 34 to the outer pocket 36 to present a concave shape, relative to the center of the opening 38.

In each of the embodiments shown in FIGS. 2-6, the undercrown surface 32 located along the pockets 36 is curved or sloped upwardly from the opening 38 to the ring belt 16 to present a concave surface when viewed from the bottom of the piston 10.

Figure 5A:
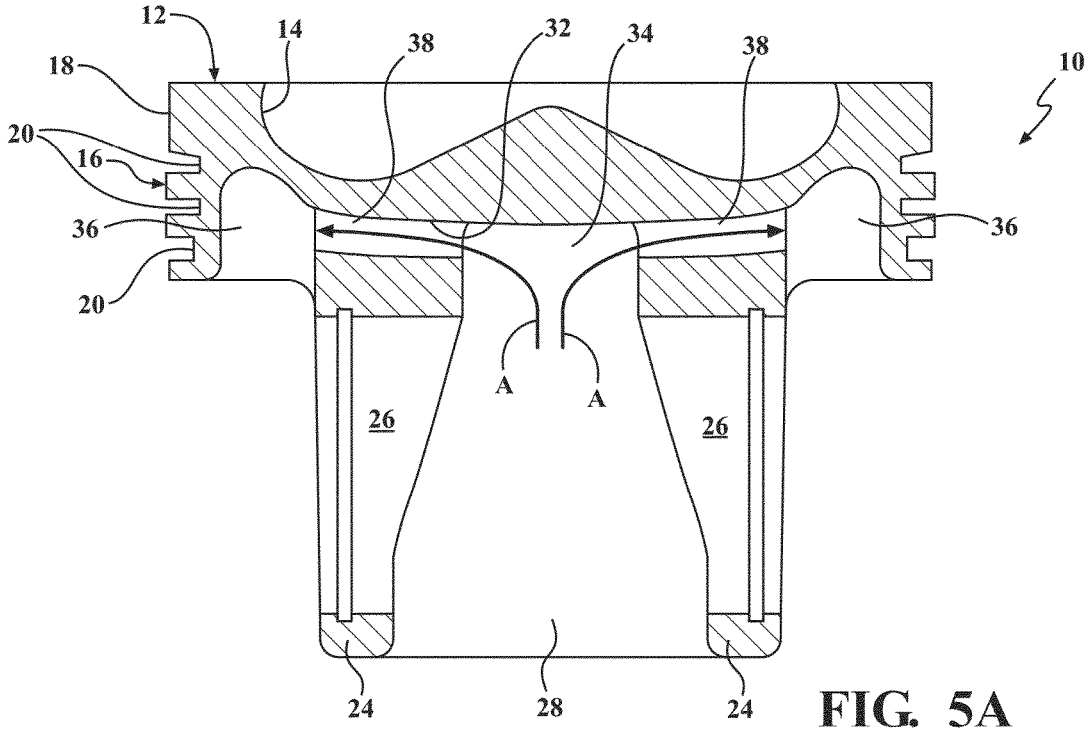
FIG. 5A illustrates movement of cooling oil in the piston of FIG. 5 during operation in an internal combustion engine.
Figure 6A:
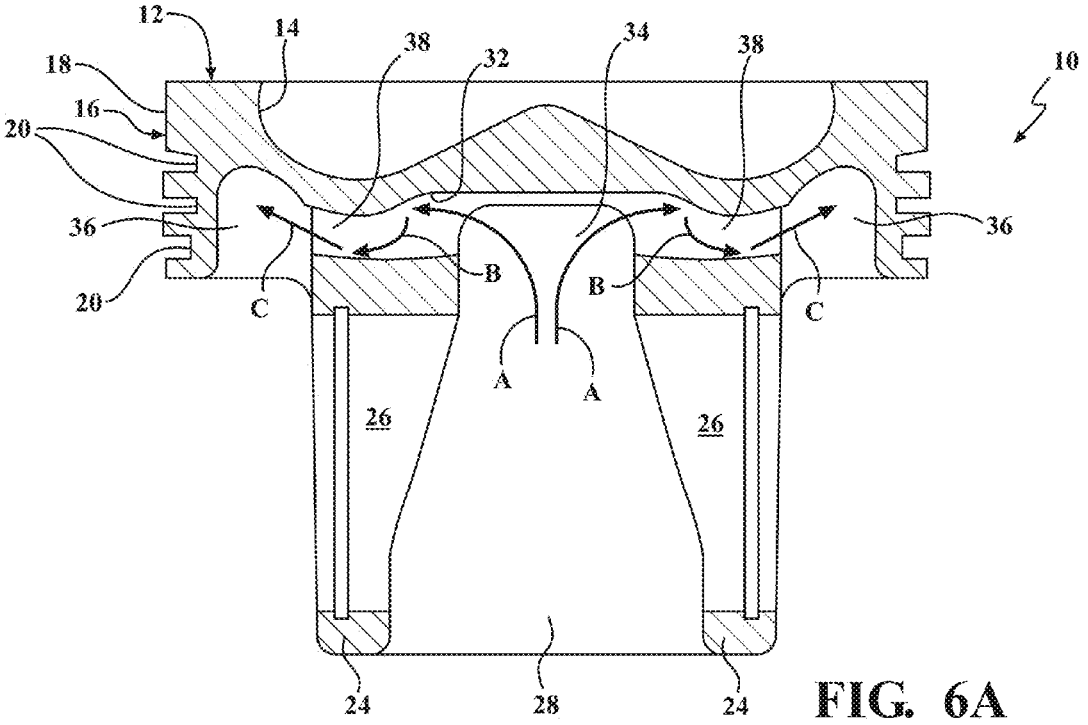
FIG. 6A illustrates movement of cooling oil in the piston of FIG. 6 during operation in an internal combustion engine.

The piston 10 designed according to the present invention is able to achieve improved cooling of the outer pockets 36, compared to galleryless pistons without the openings 38 above the pin bore 26. For example, in the embodiment of FIG. 5, as the piston 10 descends, the oil moves toward the undercrown surface 32 and follows the curvature of the undercrown surface 32 through the openings 38 and to the outer pockets 36, as shown at locations A of FIG. 5A. In the embodiment of FIG. 6, as the piston 10 descends, the oil moves toward the undercrown surface 32 and spreads out along the undercrown surface 32, as shown at locations A of FIG. 6A. As the piston 10 of FIG. 6 ascends, the oil moves towards the bottom of the piston 10, through the openings 38 and outwards of the pin bosses 24, as shown at locations B of FIG. 6A. As the piston 10 of FIG. 6 descends again, the oil moves toward the undercrown surface 32 again and enters the outer pockets 36, as shown at locations C of FIG. 6A.

Another aspect of the invention provides a method of manufacturing the galleryless piston 10 for use in the internal combustion engine. The body portion of the piston 10, which is typically formed of steel, can be manufactured according to various different methods, such as forging or casting. The body portion of the galleryless piston 10 can also comprise various different designs, and examples of the possible designs are shown in FIGS. 1-6.

The method further includes providing the openings 38 in the pin bosses of the piston 10 which extend from the inner undercrown region 34 to the outer pockets 36. This step can include forming the holes 38 during the process of casting the monolithic body, forming the holes 38 during the process of forging the monolithic body, or machining the openings 38 after providing the monolithic body.

As discussed above, the piston 10 is free of a closed cooling gallery along the undercrown surface 32 and thus has a reduced weight and related costs, relative to pistons including a closed cooling gallery, and also operates at a reduced temperature during operation in an internal combustion engine relative to other galleryless pistons, which contributes to improved thermal efficiency, fuel consumption, and performance of the engine.

Many modifications and variations of the present invention are possible in light of the above teachings and may be practiced otherwise than as specifically described while within the scope of the claims.

The invention claimed is:

1. A piston, comprising:

an upper wall including an undererown surface exposed from an underside of said piston, a ring belt depending from said upper wall and extending circumferentially around a center axis of said piston, a pair of pin bosses depending from said upper wall, a pair of skirt panels depending from said ring belt and coupled to said pin bosses by struts, an inner undercrown region extending along said undererown surface and surrounded by said skirt panels and said struts and said pin bosses, a first outer pocket and a second outer pocket each extending along said undercrown surface, said first outer pocket being surrounded by a portion of said ring belt, one of said pin bosses, and two off, said struts, said second outer pocket being surrounded by another portion of said ring belt, another one of said pin bosses, and another two of said struts, and an opening extending through one of said pin bosses from said inner undercrown region to one of said outer pockets.

2. The piston of claim 1, wherein said opening is disposed between said undercrown surface and a pin bore of said pin boss.

3. The piston of claim wherein said opening and a pin bore of said pin boss each present a cross-sectional area when said piston is viewed in cross-section from a side facing said pin boss, and said cross-sectional area of said opening is less than said cross-sectional area of said pin bore.

4. The piston of claim 3, wherein said cross-sectional area of said opening is 10% to 50% of said cross-sectional area of said pin bore.

5. The piston of claim 1, wherein said opening has a length extending from said undercrown surface to a lower surface of said opening and a width extending between opposite side surfaces of said opening, and said width is greater than said length.

6. The piston of claim 1, wherein when said piston is viewed in cross-section in a direction facing said pin boss, said undercrown surface presents a cross-sectional shape which is upwardly curved along said opening relative to a center of said opening, said opening includes a lower surface which is upwardly curved along said opening relative to a center of said opening, and said opening includes side surfaces which are concave relative to a center of said opening.

7. The piston of claim 1, wherein when said piston is viewed in cross-section in a direction facing said pin boss said undercrown surface presents u cross-sectional shape which is straight along said opening, said opening includes a lower surface which is straight along said opening, and said opening includes side surfaces which are concave relative to a center of said opening.

8. The piston of claim 1, wherein said pin boss including said opening also includes a pin bore, and when said piston is viewed in cross-section along a width of said pin bore, said undercrown surface is convex along said opening relative to a center of said opening, and a lower surface of said opening is straight along said opening.

9. The piston of claim 1, wherein said pin boss including said opening also includes a pin bore, and when said piston is viewed in cross-section along a width of said pin bore, a first portion of said undercrown surface extending tom said inner undercrown region is straight along said opening, and a second portion of said undercrown surface extending from said first portion to said outer pocket is convex along said opening relative to a center of said opening.

10. The piston of claim 1, wherein said piston includes a body formed of a single piece of material, said body includes said upper wall, said ring belt, said pin bosses, and said skirt panels.

11. The piston of claim 10, wherein said material of said body is formed of steel.

12. The piston of claim 1, wherein said piston does not include a cooling gallery floor or other feature bounding or partially bounding a cooling gallery.

13. The piston of claim 1 including a body formed of a single piece of material, said material of said body is formed of steel, said body does not have a cooling gallery floor or other features bounding or partially bounding a cooling gallery, said body includes said upper wall presenting an upper combustion surface, said upper combustion surface is a non-planar surface around said center axis, said ring belt includes a top land and a plurality of ring grooves extending circumferentially around said center axis and along an outer diameter of said piston, said pin bosses are disposed inwardly of said ring belt and provide a pair of laterally spaced pin bores surrounding a pin bore axis, said pair of skirt panels are located diametrically opposite one another, said undercrown surface is disposed radially inwardly of said ring belt, said undercrown surface is not bounded by an enclosed or partially enclosed cooling gallery, a first portion of said undercrown surface is provided by said inner undercrown region and a second portion of said undercrown surface is provided by said outer pockets, said inner undererown region is located at said center axis and is surrounded by said pin bosses and said skirt panels and said struts, said undercrown surface located in said inner undercrown region is concave when viewed from the bottom of said piston, said outer pockets are located outwardly of said pin bosses, said opening of said pin, boss is disposed between said undercrown surface and said pin bore of said pin boss, said opening of said pin boss is spaced from said pin bore by a portion of said pin boss, said opening of said phi boss and said pin bore of said pin boss each present a cross-sectional area when said piston is viewed in cross-section in a direction facing said pin boss, said cross-sectional area of said opening is 10% to 50% of said cross-sectional area of said pin bore, said opening extends from said undercrown surface to a lower surface with side surfaces connecting said undercrown surface and said lower surface;

said opening of said pin boss has a length extending from said undercrown surface to said lower surface and a width extending between said opposite side surfaces which is greater than said length, and both of said pin bosses include said opening.

14. A method of manufacturing a piston, comprising the steps of:

providing a body including an upper wall, the upper wall including an undercrown surface exposed from an underside of the piston; a ring belt depending m the upper wall and extending circumferentially around a center axis of the piston; a pair of pin bosses depending from the upper wall; a pair of skirt panels depending from the ring belt and coupled to the pin bosses by struts; an inner undercrown region extending along the undercrown surface and surrounded by the skirt panels and the struts and the pin bosses; a first outer pocket and a second outer pocket each extending along the undercrown surface; the first outer pocket being surrounded by a portion of the ring belt, one of the pin bosses, and two of the struts; the second outer pocket being surrounded by another portion of the ring belt, another cane of the pin bosses, and another two of the struts; and forming an opening extending through one of the pin bosses from the inner undercrown region to one of the outer pockets.

15. The method of claim 14, wherein the step of forming the opening includes machining the opening through the pin boss.

16. The method of claim 14, wherein the body is a single piece of material, and the step of providing the body includes forging or casting the body.

17. The method of claim 16, wherein the opening is formed during the forging or casting stop.

18. The method of claim 14, wherein the opening is formed between the undercrown surface and a pin bore of the pin boss.

19. The method of claim 14, wherein the opening and a pin bore of the pin boss each present, a cross-sectional area when the piston is viewed in cross-section from a side facing the pin boss, and the cross-sectional area of the opening is 10% to 50% of the cross-sectional area of the pin bore.

* * * * *